US006712395B1

(12) United States Patent
Lee

(10) Patent No.: US 6,712,395 B1
(45) Date of Patent: Mar. 30, 2004

(54) FOOTWEAR CAPABLE OF BEING USED INTERCHANGEABLY AS A JUMPSHOE OR ROLLER SKATE

(76) Inventor: Yan-Yee Lee, 16 Lane 667, Chang Shang Road, Sir Nan Village, Sun Kang Hsiang, Taichung Hsien (TW)

( * ) Notice: Subject to any disclaimer, the term of this patent is extended or adjusted under 35 U.S.C. 154(b) by 44 days.

(21) Appl. No.: 10/105,560

(22) Filed: Mar. 25, 2002

(51) Int. Cl.[7] ..... A63C 17/26

(52) U.S. Cl. ..... 280/809; 280/11.19; 280/11.26; 280/11.28

(58) Field of Search ..... 280/7.12, 7.13, 280/7.14, 11.19, 11.223, 11.224, 11.225, 11.26, 11.27, 11.28, 809, 825; 36/62, 81, 97, 115

(56) References Cited

U.S. PATENT DOCUMENTS

| | | | | | |
|---|---|---|---|---|---|
| 3,281,971 | A | * | 11/1966 | Weitzner | 36/100 |
| 4,008,901 | A | * | 2/1977 | Conn | 280/7.13 |
| 4,304,417 | A | * | 12/1981 | Hsieh | 280/11.26 |
| 4,727,662 | A | * | 3/1988 | Ilon | 36/132 |
| 5,224,718 | A | * | 7/1993 | Gertler | 280/11.19 |
| 5,393,077 | A | * | 2/1995 | Wanous | 280/7.13 |
| 5,621,984 | A | * | 4/1997 | Hsieh | 36/28 |
| 5,803,467 | A | * | 9/1998 | Piotrowski | 280/7.14 |
| 6,065,763 | A | * | 5/2000 | Adams, Jr. | 280/11.28 |
| 6,082,745 | A | * | 7/2000 | Pellegrini et al. | 280/11.221 |
| 6,135,463 | A | * | 10/2000 | Wrike | 280/11.221 |
| 6,497,420 | B2 | * | 12/2002 | Ricci | 280/11.16 |

FOREIGN PATENT DOCUMENTS

| | | | | |
|---|---|---|---|---|
| CA | 769611 | * | 10/1967 | 280/7.13 |
| FR | 2672812 | * | 8/1992 | 280/11.26 |
| WO | 93/07938 | * | 4/1993 | 280/7.13 |

* cited by examiner

*Primary Examiner*—Frank Vanaman
(74) *Attorney, Agent, or Firm*—Harrison & Egbert

(57) ABSTRACT

A dual-purpose sports footwear is formed of a boot, an elastic plate, an arcuate outer plate, and a wheel mount plate. The boot has an arcuate inner plate which is detachably fastened to the elastic plate. The arcuate outer plate is detachably fastened to the elastic plate. The boot, the elastic plate and the arcuate outer plate form a jumpshoe. The wheel mount plate is provided with a plurality of wheel sets and is detachably fastened to the arcuate inner plate of the boot to form a roller skate.

6 Claims, 9 Drawing Sheets

FOOTWEAR CAPABLE OF BEING USED INTERCHANGEABLY AS A JUMPSHOE OR ROLLER SKATE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to sports footwear, and more particularly to a dual-purpose footwear which is used interchangeably as a jumpshoe or a roller skate.

BACKGROUND OF THE INVENTION

Conventional sports shoes, such as roller skates, ice skates, and jumpshoes, are basically similar in construction in that they all have a boot and a sole; nevertheless they cannot be used interchangeably due to the fact that their soles are provided with different runners fastened thereunder. From the standpoint of consumer, a dual-purpose sports shoe is not only useful but also economical.

BRIEF SUMMARY OF THE INVENTION

The primary objective of the present invention is to provide a dual-purpose sports footwear which can be used interchangeably as jumpshoe and roller skate.

In keeping with the principle of the present invention, the foregoing objective of the present invention is attained by a footwear comprising a boot, an elastic plate, an arcuate outer plate, and a wheel mount plate. The boot has a sole to which an arcuate inner plate is fastened. The arcuate inner plate can be joined with the elastic plate and the arcuate outer plate or wheel mount plate. As a result, the footwear of the present invention can be used interchangeably as jumpshoe and roller skate.

The features and the advantages of the present invention will be more readily understood upon a thoughtful deliberation of the following detailed description of the present invention with reference to the accompanying drawings.

DETAILED DESCRIPTION OF THE INVENTION

Figure 1:
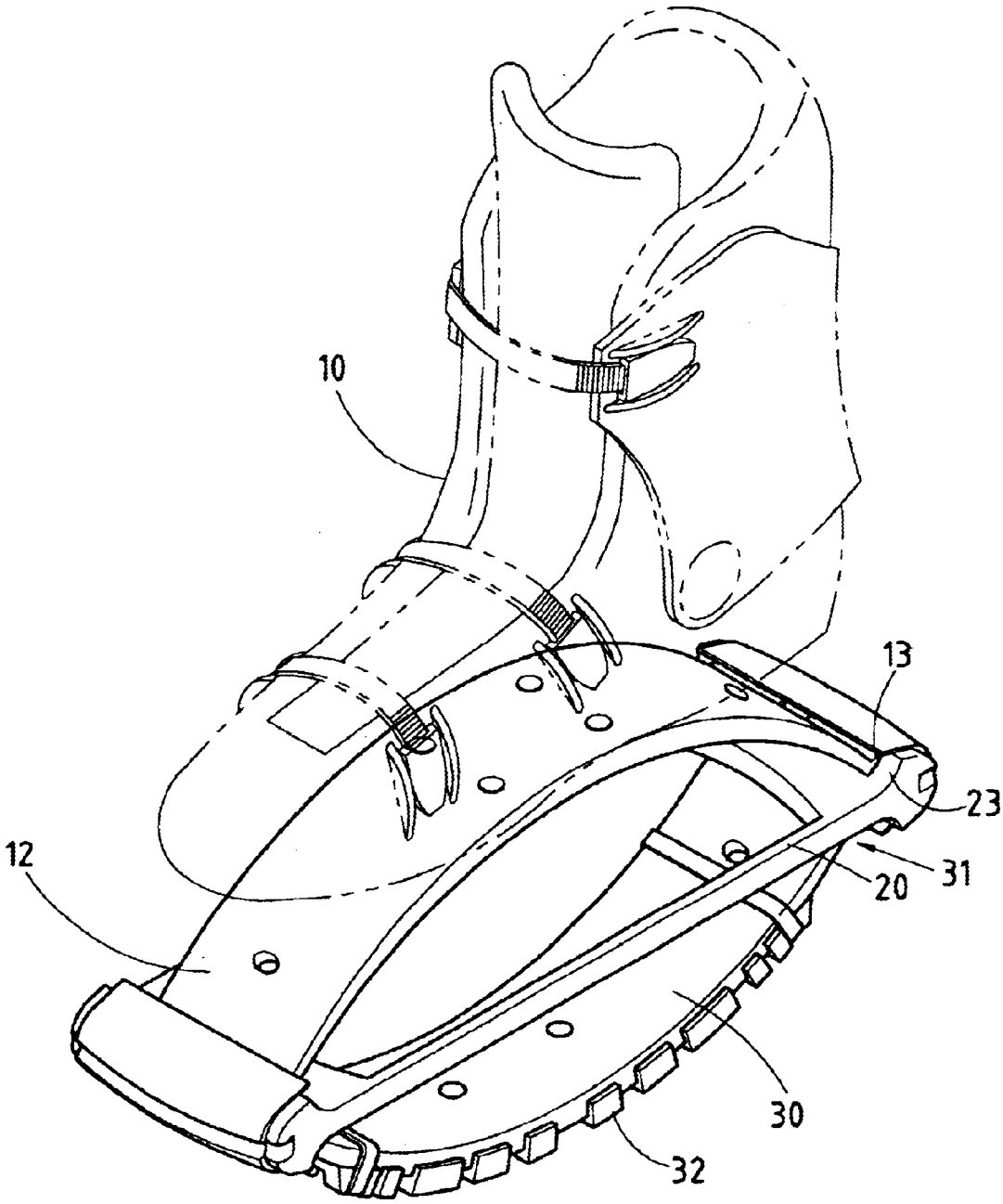
FIG. 1 shows a perspective view of a jumpshoe of the present invention.
Figure 2:
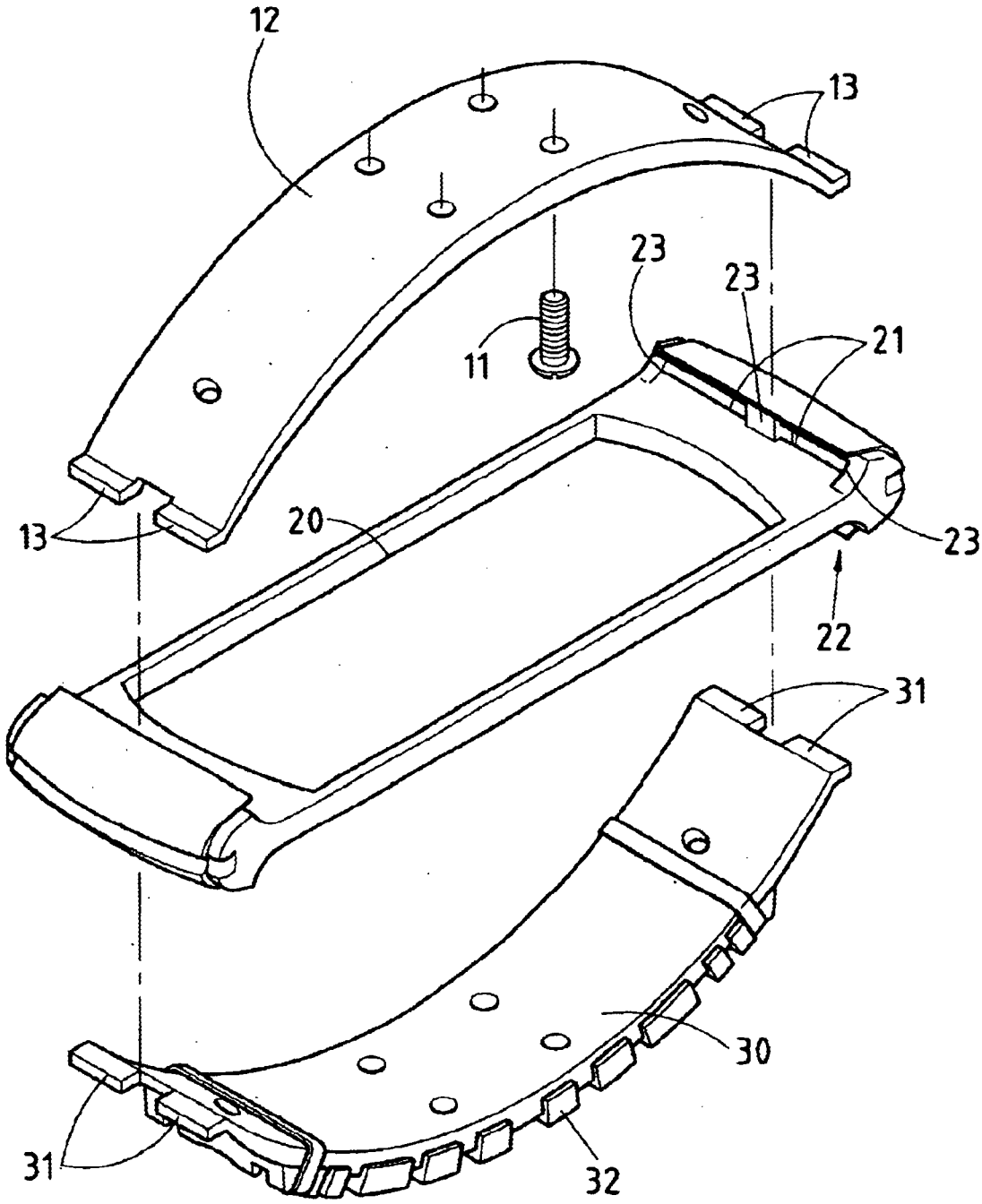
FIG. 2 shows a partial exploded view of the present invention as shown in FIG. 1.

As shown in FIGS. 1–6, a dual-purpose footwear embodied in the present invention is formed of a boot 10, an elastic plate 20, an arcuate outer plate 30, and a wheel mount plate 40.

The boot 10 is provided in the underside of the sole thereof with an arcuate inner plate 12 fastened therewith by a plurality of fastening bolts 11. The arcuate inner plate 12 is provided at two longitudinal ends with two retaining projections 13.

The elastic plate 20 is provided in the upper side of two longitudinal ends thereof with two upper retaining slots 21 corresponding in location to the two retaining projections 13 of the arcuate inner plate 12 of the boot 10. The elastic plate 20 is joined with the arcuate inner plate 12 such that the retaining projections 13 of the arcuate inner plate 12 are removably fitted into the upper retaining slots 21 of the elastic plate 20. Located between the two upper retaining slots 21 is a stop portion 23 for prevention the elastic plate 20 from swaying. The elastic plate 20 is further provided in the underside of two longitudinal ends thereof with two lower retaining slots 22 opposite in location to the upper retaining slots 21.

The arcuate outer plate 30 is corresponding in shape and radian to the arcuate inner plate 12 and is fastened to the underside of the elastic plate 20. The arcuate outer plate 30 is provided at two longitudinal ends with two retaining portions 31, which are removably fitted into the lower retaining slots 22 of the elastic plate 20. The arcuate outer plate 30 is provided in the underside with a skidproof pad 32.

The wheel mount plate 40 is provided at two longitudinal ends with two retaining slots 41 and is joined with the arcuate inner plate 12 of the boot 10 such that the retaining projections 13 of the arcuate inner plate 12 are removably fitted into the retaining slots 41 of the wheel mount plate 40.

The footwear of the present invention is used as a jumpshoe when the arcuate inner plate 12 of the boot 10 is joined with the elastic plate 20, which is in turn joined with the arcuate outer plate 30, as shown in FIG. 1.

Figure 5:
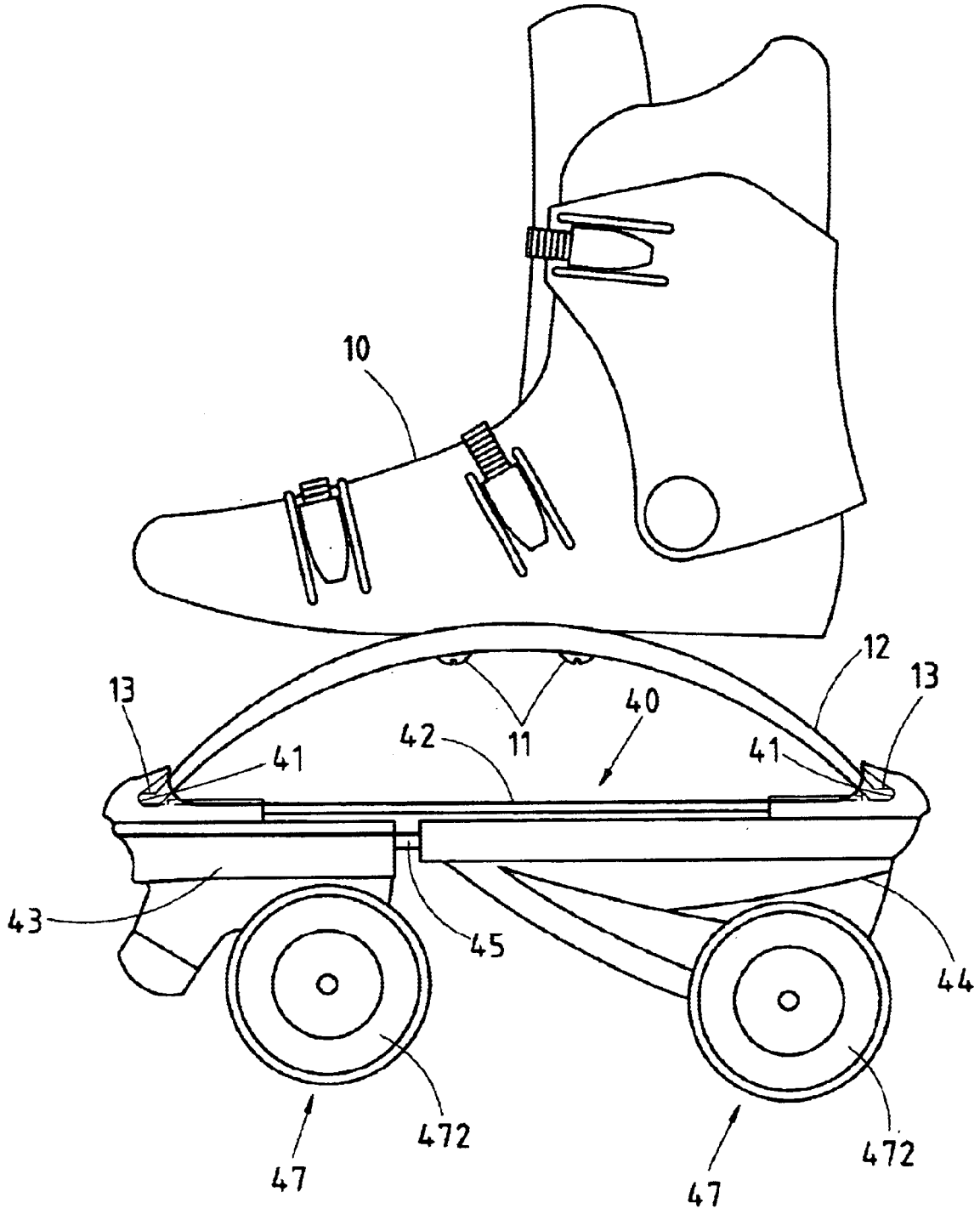
FIG. 5 shows a side schematic view of the present invention being used as a roller skate.

The footwear of the present invention is used as a roller skate when the arcuate inner plate 12 of the boot 10 is joined with the wheel mount plate 40, as shown in FIG. 5.

Figure 3:
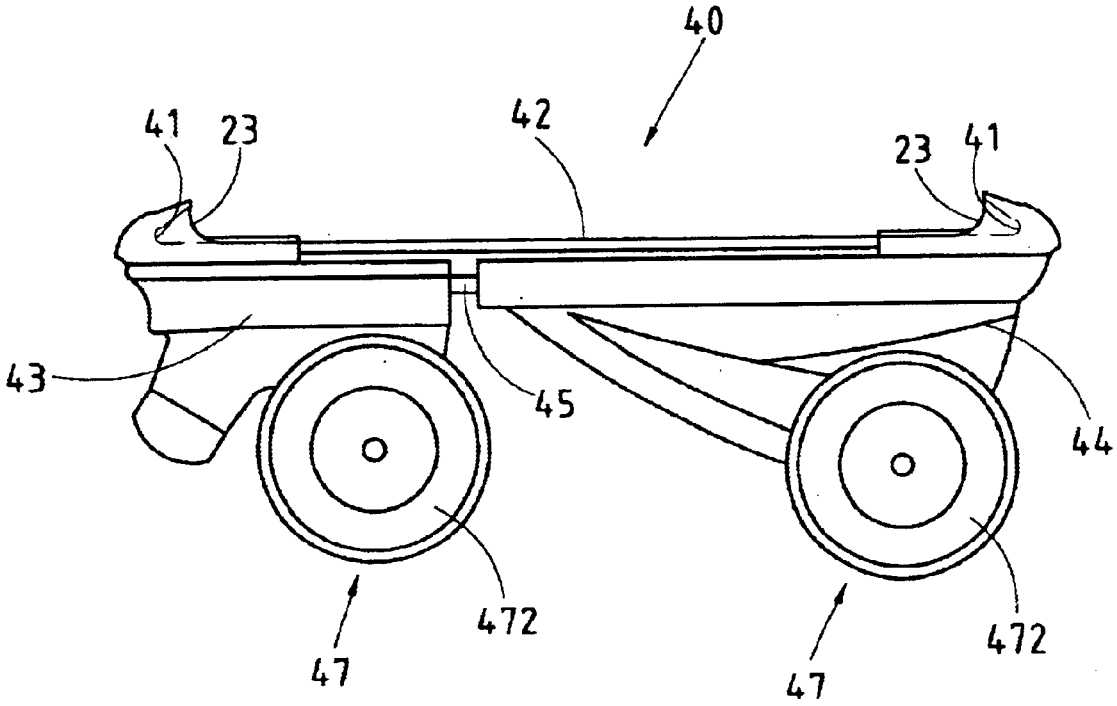
FIG. 3 shows a side schematic view of the wheel seat plate of the present invention.
Figure 4:
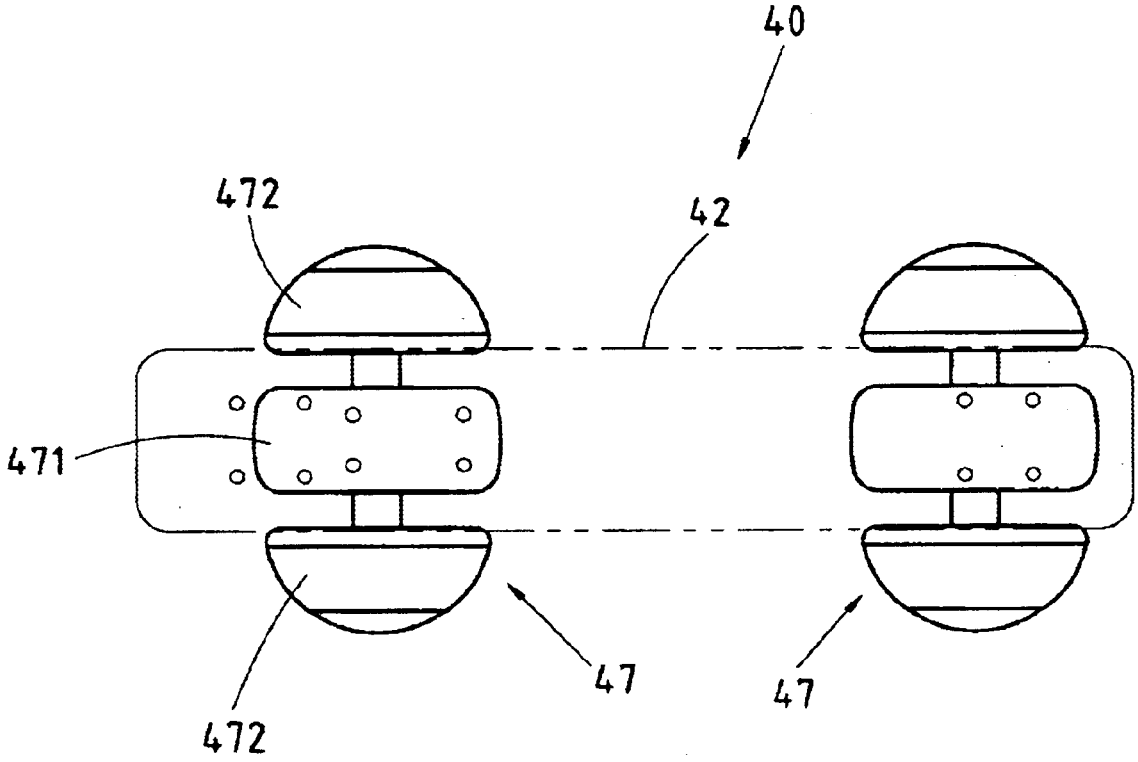
FIG. 4 shows a top plan view of the present invention as shown in FIG. 3.
Figure 6:
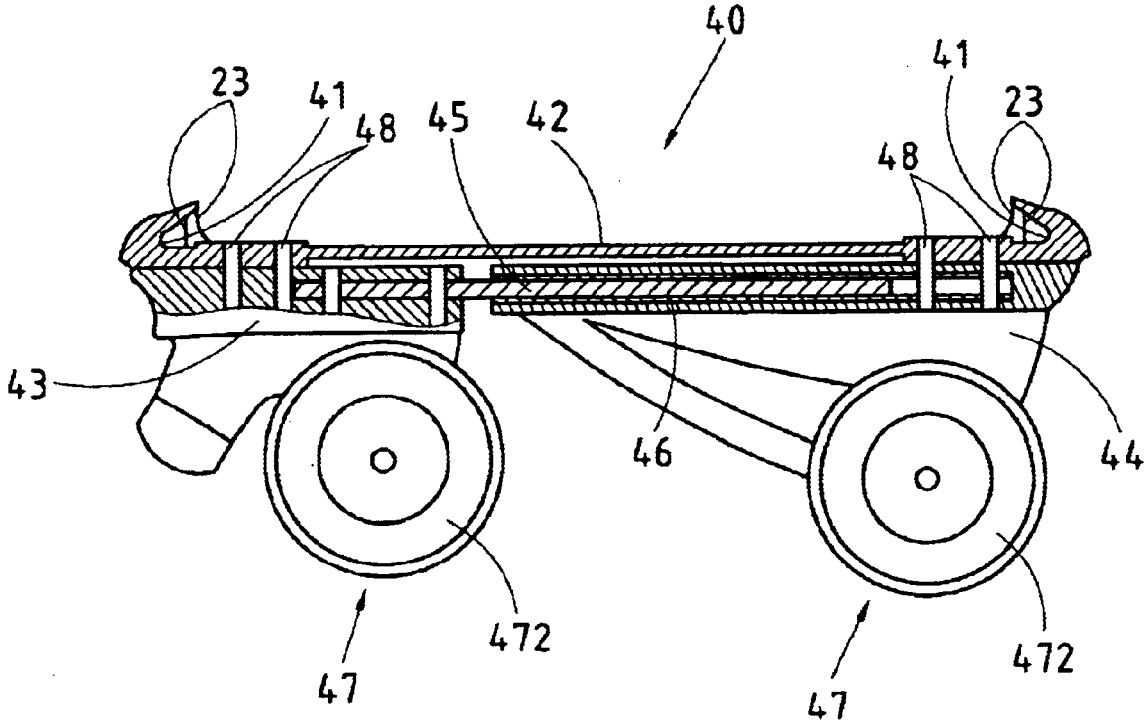
FIG. 6 shows a sectional schematic view of the wheel seatplate of the present invention as shown in FIG. 5.

As shown in FIGS. 3, 4, and 6, the wheel mount plate 40 is formed of an elastic wheel plate 42, a front wheel frame 43 fastened to the underside of the front end of the elastic wheel plate 42, and a rear wheel frame 44 fastened to the underside of the rear end of the elastic wheel plate 40. The front wheel frame 43 and the rear wheel frame 44 are connected by a connection plate 45, which is fastened securely at the front end with the front wheel frame 43 and is pivotally fastened at the rear end with a slide frame 46 of the rear wheel frame 44. The connection plate 45 serves to give an added strength to the elastic wheel plate 42. The front wheel frame 43 and the rear wheel frame 44 are fastened with the elastic wheel plate 42 by a plurality of screws 48. The wheel frames 43 and 44 are used to mount pivotally a wheel set 47, which is formed of a center wheel 471, and two side wheels 472 of a semicircular construction.

The center wheel 471 is located between the two side wheels 472, as shown in FIG. 4. The two side wheels 472 are intended to facilitate the negotiating of a curve by a roller skater, especially by a beginner.

Figure 7:
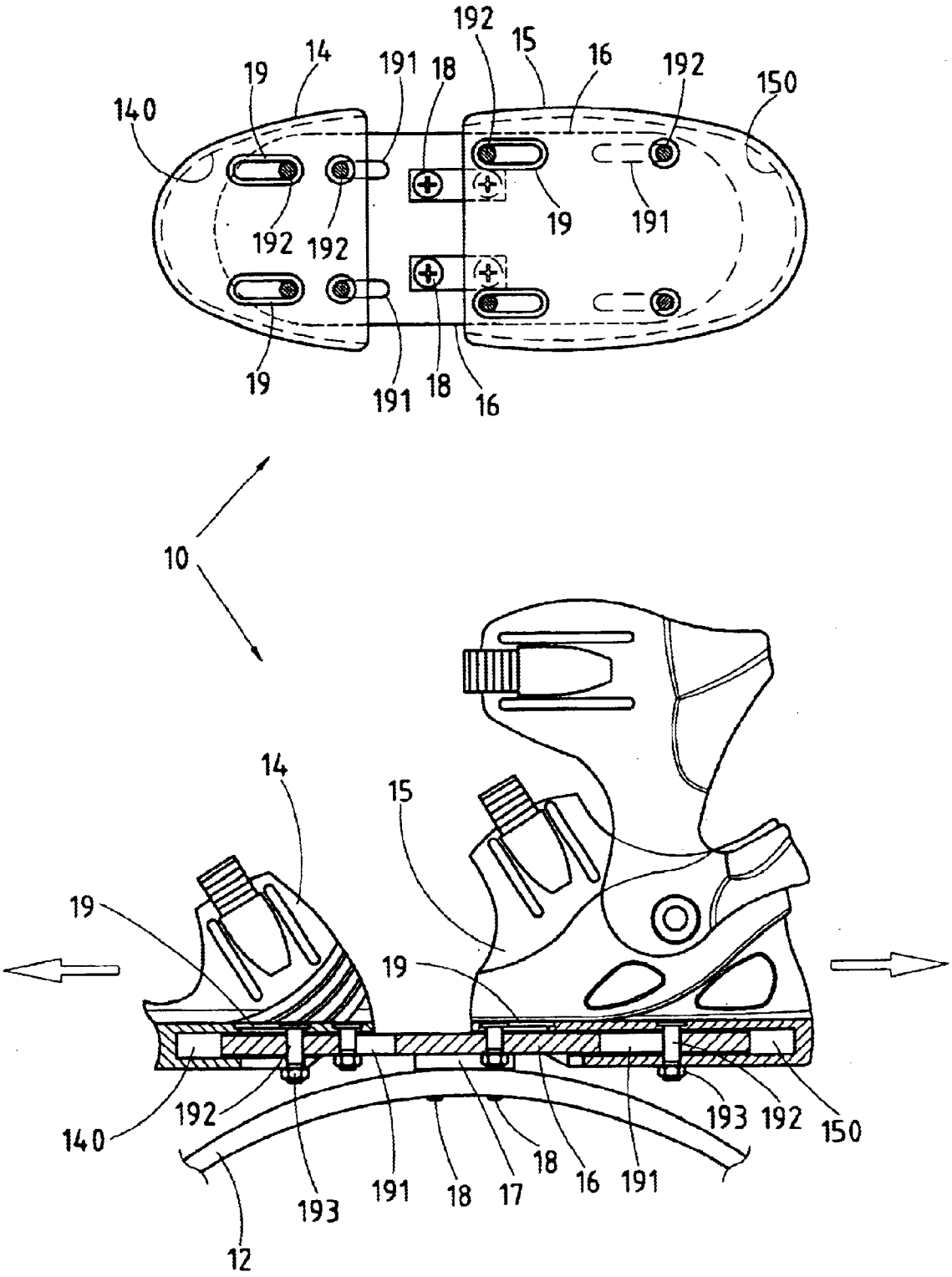
FIG. 7 shows bottom and side schematic views of another preferred embodiment of the present invention in action.
Figure 8:
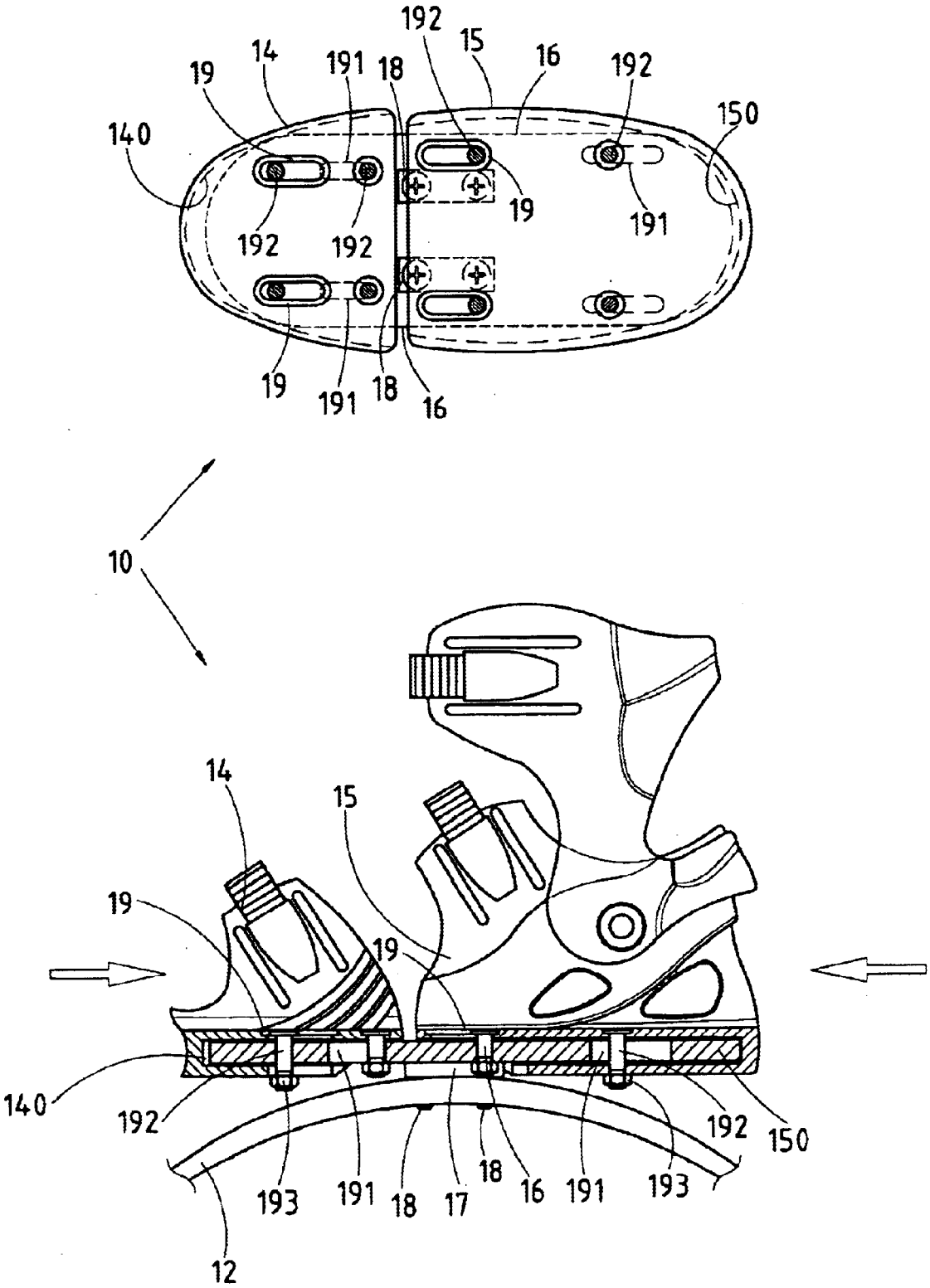
FIG. 8 shows more bottom and side schematic views of the preferred embodiment of the present invention as shown in FIG. 7.
Figure 9:
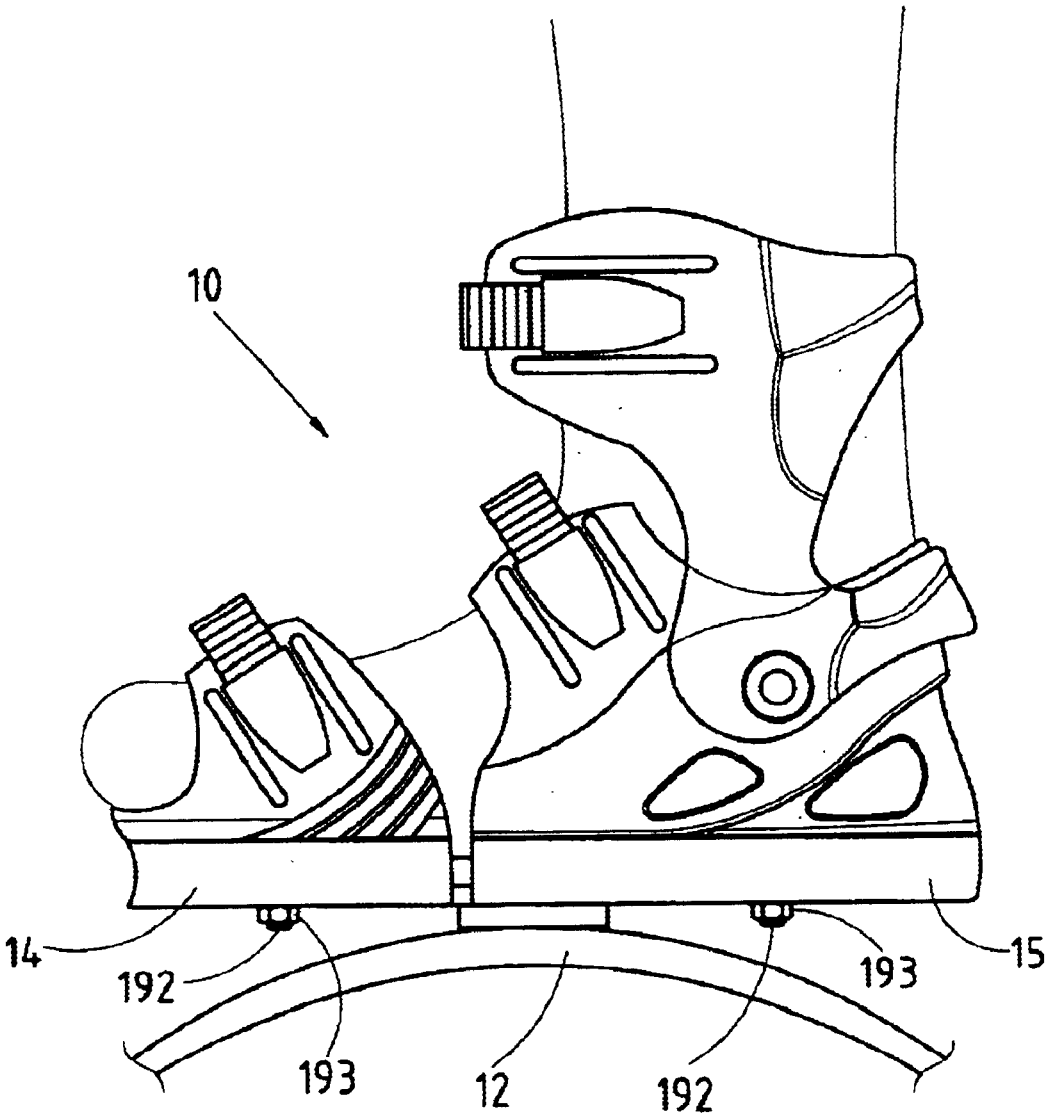
FIG. 9 shows a side schematic view of the boot of the present invention as shown in FIG. 7.

As shown in FIGS. 7, 8, and 9, the boot 10 of the footwear of the present invention is formed of a toe boot 14 and a heel boot 15, which are respectively provided in the sole thereof with a slide slot 140, 150 for disposing a guide slide plate 16. Located at the juncture of the soles of the toe boot 14 and the heel boot 15 is a reinforcing plate 17. The guide slide plate 16 and the reinforcing plate 17 are fastened with the arcuate inner plate 12 by a plurality of fastening bolts 18. The toe boot 14 and the heel boot 15 are provided with a plurality of adjustment holes 19 and 191 for adjusting the positions of the toe boot 14 and the heel boot 15 in conjunction with bolts 192 and nuts 193.

The elastic plate 20 is provided with a plurality of elastic strips 24 extending between the two longitudinal ends of the elastic plate 20.

The present invention described above is to be regarded in all respects as being merely illustrative. Accordingly, the present invention may be embodied in other specific forms without deviating from the spirit thereof. For example, the wheel set 47 of the wheel mount plate 40 of the present invention may be formed of only the center wheel 471. The present invention is therefore to be limited only by the scope of the following claims.

I claim:

1. A dual-purpose sports footwear comprising:

a boot having an arcuate inner plate fastened to an underside of a sole of said boot, said arcuate inner plate having at least one retaining projection at opposite longitudinal ends thereof;

an elastic plate having at least one upper retaining slot formed in an upper side of opposite longitudinal ends of said elastic plate, the upper retaining slots corresponding in location to the retaining projections of said arcuate inner plate of said boot, said elastic plate being joined with said arcuate inner plate such that the retaining projections of said arcuate inner plate are removably retained in the upper retaining slots of said elastic plate, said elastic plate having at least one lower retaining slot formed in an underside of opposite longitudinal ends of said elastic plate, the lower retaining slots being opposite in location to the upper retaining slots;

an arcuate outer plate having at least one retaining portion formed at opposite longitudinal ends thereof, the retaining portions being fastened to an underside of said elastic plate such that the retaining portions of said arcuate outer plate are removably retained in the lower retaining slots of said elastic plate; and a wheel mount plate having at least one retaining slot formed at opposite longitudinal ends thereof, the retaining slots of said wheel plate mount corresponding in location to the retaining projections of said arcuate inner plate of said boot, said wheel mount plate further having a plurality of wheel sets fastened pivotally therewith at an underside thereof whereby said wheel mount plate is joined with said boot, the retaining projections of said arcuate inner plate of said boot being removably retained in the retaining slots of said wheel mount plate.

2. The dual-purpose sports footwear as defined in claim 1, wherein said elastic plate has a plurality of elastic strips.

3. The dual-purpose sports footwear as defined in claim 1, wherein said arcuate outer plate has a skidproof pad fastened therewith at an underside thereof.

4. The dual-purpose sports footwear as defined in claim 1, wherein said wheel mount plate comprises:

an elastic wheel plate;

a front wheel frame fastened to an underside of a front end of said elastic wheel plate;

a rear wheel frame fastened to an underside of a rear end of said elastic wheel plate; and a connection plate connecting said front wheel frame with said rear wheel frame, said plurality of wheel sets of said wheel mount plate being pivotally fastened to said front wheel frame and to said rear wheel frame whereby said plurality of wheel sets are respectively formed of two side wheels of a semicircular shape and a center wheel mounted between said two side wheels.

5. The dual-purpose sports footwear as defined in claim 4, wherein said rear wheel frame has a slide frame, said connection plate being fastened at a front end to said front wheel frame and being pivoted at a rear end with said slide frame of said rear wheel frame.

6. The dual-purpose sports footwear as defined in claim 1, wherein said boot is formed of a toe boot and a heel boot, said toe boot and said heel boot having a slide slot formed in a sole thereof and a guide slide plate disposed in said slide slot, said toe boot and said heel boot having a reinforcing plate at the juncture of the respective soles thereof, said guide slide plate and said reinforcing plate being fastened to said arcuate inner plate by a plurality of fastening bolts, said toe boot and said heel boot having a plurality of adjustment holes suitable for adjusting a distance between said toe boot and said heel boot in conjunction with a plurality of bolts and nuts.

* * * * *